US012262816B2

(12) United States Patent
Wagner

(10) Patent No.: US 12,262,816 B2
(45) Date of Patent: Apr. 1, 2025

(54) MATTRESSES, METHODS OF MANUFACTURE AND COMPONENTS

(71) Applicant: Ashley Furniture Industries, LLC, Arcadia, WI (US)

(72) Inventor: Travis Wagner, Lexington, NC (US)

(73) Assignee: Ashley Furniture Industries, LLC., Arcadia, WI (US)

( * ) Notice: Subject to any disclaimer, the term of this patent is extended or adjusted under 35 U.S.C. 154(b) by 744 days.

(21) Appl. No.: 17/178,892

(22) Filed: Feb. 18, 2021

(65) Prior Publication Data

US 2021/0251391 A1 Aug. 19, 2021

Related U.S. Application Data

(60) Provisional application No. 62/978,288, filed on Feb. 18, 2020.

(51) Int. Cl.
*B65B 5/04* (2006.01)
*A47C 27/00* (2006.01)
(Continued)

(52) U.S. Cl.
CPC ..... *A47C 27/002* (2013.01); *A47C 27/064* (2013.01); *A47C 31/105* (2013.01);
(Continued)

(58) Field of Classification Search
CPC ... A47C 27/002; A47C 27/064; A47C 31/105; B65B 5/045; B65B 5/04
See application file for complete search history.

(56) References Cited

U.S. PATENT DOCUMENTS 3,287,749 A 11/1966 Marsico
3,818,521 A * 6/1974 Richards, Jr. ..... A47C 31/001 297/DIG. 5
(Continued)

FOREIGN PATENT DOCUMENTS

KR 20-2013-0001508 U 8/2011

OTHER PUBLICATIONS

International Search Report and Written Opinion for Application No. PCT/US2021/018575, mailing date Aug. 4, 2021, 19 pages.

*Primary Examiner* — Justin C Mikowski
*Assistant Examiner* — Ifeolu A Adeboyejo
(74) *Attorney, Agent, or Firm* — Christensen, Fonder, Dardi & Herbert PLLC; Douglas J. Christensen; Andrew H. Auderieth

(57) ABSTRACT

Mattress coverings are manufactured utilizing conventional equipment and using a dummy mattress core. The mattress coverings include a zippered access on the bottom panel, for example, where the dummy core can be removed after the mattress covering is completed. When shipped to a regional assembly facility the zippered access is utilized for insertion of a select mattress core that corresponds to the size of the dummy mattress core about which the mattress covering was assembled. The zippered access is zipped shut and the mattress is ready for sale, transport, and use. Great efficiencies are available where the mattress cover is assembled in a first location, shipped to a sale and use location and also regionally close to where mattress cores are manufactured, and the mattress covers are assembled with cores into mattresses.

9 Claims, 8 Drawing Sheets

(51) Int. Cl.

| | |
|---|---|
| ***A47C 27/06*** | (2006.01) |
| ***A47C 31/10*** | (2006.01) |
| ***B65D 75/00*** | (2006.01) |
| ***B65D 85/64*** | (2006.01) |

(52) U.S. Cl.
CPC ..... *B65D 75/002* (2013.01); *B65D 85/64* (2013.01); *B65D 2585/647* (2013.01)

(56) References Cited

U.S. PATENT DOCUMENTS 4,449,261 A 5/1984 Magnusson
4,462,129 A 7/1984 Brannock
4,809,375 A 3/1989 Bull
5,109,559 A * 5/1992 West ..... A47C 27/085 5/691
5,136,741 A 8/1992 Balonick et al.
5,285,542 A * 2/1994 West ..... B32B 5/26 5/422
5,461,737 A * 10/1995 Ikeda ..... A47C 27/002 5/716
5,475,881 A * 12/1995 Higgins ..... A47C 31/105 5/737
5,557,813 A 9/1996 Steed et al.
5,655,241 A * 8/1997 Higgins ..... A47C 31/105 5/737
5,896,605 A 4/1999 Branman
6,877,177 B1 * 4/2005 Marcangelo ..... A47C 27/003 5/411
6,954,957 B2 10/2005 Metzger et al.
7,089,618 B1 8/2006 Metzger
7,150,059 B2 * 12/2006 Small, Jr. ..... D06M 15/263 5/954
7,386,903 B2 6/2008 Hochschild
7,426,767 B2 9/2008 Mossbeck
9,706,851 B2 7/2017 Malkiewiez et al.
2002/0148047 A1 10/2002 Corzani et al.
2003/0177583 A1 * 9/2003 Freeman ..... A47C 27/056 5/721
2004/0133987 A1 7/2004 Reeder et al.
2005/0132498 A1 * 6/2005 Vrionis ..... A47G 9/0246 5/737
2006/0010608 A1 1/2006 DeFranks et al.
2007/0204566 A1 * 9/2007 Lee ..... B65D 85/07 53/436
2007/0234479 A1 * 10/2007 Warshaver ..... A47C 27/15 5/690
2007/0283501 A1 * 12/2007 Mossbeck ..... A47C 27/00 5/690
2008/0098533 A1 * 5/2008 Erdman ..... A47C 27/001 5/722
2008/0201856 A1 * 8/2008 Howard ..... A47C 31/123 5/690
2008/0245690 A1 10/2008 Knewtson et al.
2009/0100606 A1 * 4/2009 An ..... A47C 27/15 5/690
2010/0192299 A1 8/2010 Schermel et al.
2010/0287707 A1 * 11/2010 Beard ..... A47C 27/081 5/706
2011/0067182 A1 * 3/2011 Kussoff ..... A47C 31/007 5/737
2013/0174350 A1 7/2013 Allman et al.
2014/0298589 A1 10/2014 Bailey
2015/0101127 A1 4/2015 Winton
2015/0313373 A1 11/2015 Myers et al.
2015/0320231 A1 11/2015 Small, Jr. et al.
2016/0128499 A1 5/2016 Jhou
2016/0157625 A1 6/2016 Schneider et al.
2016/0262549 A1 9/2016 Rawls-Meehan et al.
2016/0304231 A1 * 10/2016 Corodemus ..... B65B 5/045
2017/0079444 A1 * 3/2017 Blazar ..... A47C 27/14
2020/0260880 A1 * 8/2020 Nelson ..... A47C 19/005
2021/0219739 A1 * 7/2021 Wang ..... A47C 27/007
2021/0235884 A1 * 8/2021 Nolte ..... A47C 27/148

* cited by examiner

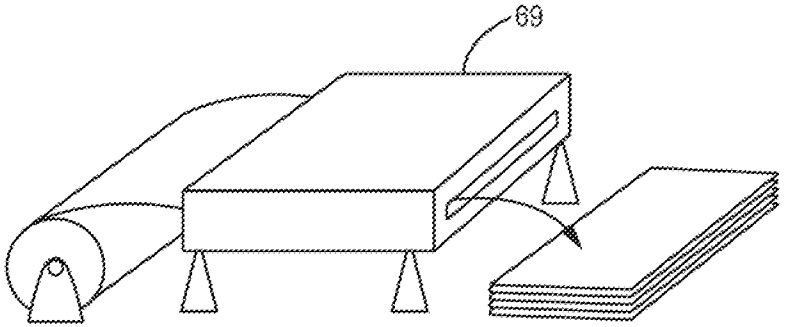
FIG. 3
(PRIOR ART)
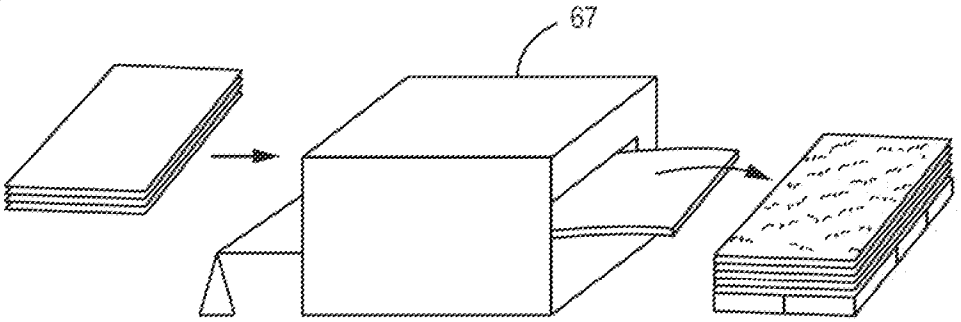
FIG. 4
(PRIOR ART)
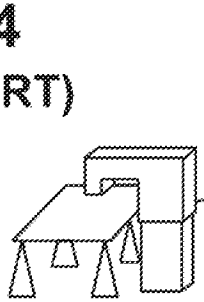
FIG. 5
(PRIOR ART)
FIG. 6
(PRIOR ART)

MATTRESSES, METHODS OF MANUFACTURE AND COMPONENTS

This application claims priority to U.S. Provisional Application No. 62/978,288 filed Feb. 18, 2020.

FIELD OF THE INVENTION

The invention pertains to mattresses and manufacturing methods thereof.

BACKGROUND OF THE INVENTION

Conventional mattresses are generally formed of some rigid yet conforming material at a core surrounded by fabrics or other materials more suitable to contact with the skin. For example, a conventional mattress might have a core of spring coils or dense foam encased in a layer of quilted fabrics. When the conventional mattress is manufactured, all components including fabrics, foam cushioning layers, and the mattress core units are warehoused at the final manufacturing facility. Modern mattresses for the covers or coverings have multiple and integrated layers of materials. Specialized cutting equipment form the accurately sized layers of materials, including loose low density fiber layers, foam layers, panels of interior fabric, and panels of exposed exterior fabric. Specialized equipment can quilt or bind layers for top panel components and sidewall border components. The layers and panels are positioned about the mattress core and a specialized tape edge machine rotates about the core with materials thereon, or the core is rotated with respect to the tape edge machine and the multiple layers are permanently affixed in an attractive tape edge seam. Although the specialized equipment allows mattresses to be manufactured in relatively short time frames, the equipment still needs trained/skilled labor and the assembly operations can be tedious.

As industries have become more specialized, it can be advantageous to source components from different locations and assemble them closer to a final destination or distribution point. Certain countries have become proficient in manufacturing textiles and efficiently producing high quality fabrics, such as those utilized for surrounding the core of a conventional mattress, at low costs and shipping them overseas. However, shipping finished products overseas can be expensive and much of the cost is attributable to the size of the product. Large, bulky products, even if lightweight, can be prohibitively expensive to ship overseas. While textiles on their own may generally be folded/rolled down to fairly small sizes, when they are permanently affixed around other structures, the end products can be large and expensive to ship. Although economies have driven many products in the furniture industry to be manufactured in Asia, mattresses sold in the U.S. are for the most part still manufactured in the U.S.

Finished mattresses are bulky and unwieldly resulting in significant expense to ship long distances. As a result, inordinately high transportation costs drive such manufacturing facilities to be close to regional distribution facilities, retail furniture stores, and customers, rather than where labor costs are more advantageous. Retail mattress stores often advertise that they manufacture their own mattresses at their retail store. This, of course, requires stocking multiple fabrics, materials, and components and having specialized equipment, and trained labor available at the store. Such can be difficult and expensive to maintain. Any improvements in the efficiencies and costs of manufacturing mattresses resulting in lower costs to the consumers would be welcomed by the industry.

SUMMARY

Although the U.S. was once home to many textile mills, such are mostly non-existent today. As a result, fabrics for mattress manufacture must be imported, often from Asia. Manufacturers of the common inner spring cores are in the U.S. and are readily available in the U.S. The inventors have developed manufacturing methods and processes that allow mattress coverings to be efficiently assembled close to the textile mills and where labor costs are advantageous. The mattress containments that form the exterior of mattresses, herein termed "coverings" are shipped in bulk to markets, such as the U.S. to regional assembly facilities where the mattress coverings are paired with selected mattress cores, such as pocketed spring cores. The mattress coverings are manufactured utilizing conventional equipment and using a dummy mattress core. The mattress coverings include a zippered access on the bottom panel, for example, where the dummy core can be removed after the mattress covering is completed. When shipped to a regional assembly facility the zippered access is utilized for insertion of a select mattress core that corresponds to the size of the dummy mattress core about which the mattress covering was assembled. The zippered access is zipped shut and the mattress is ready for sale, transport, and use.

A feature and advantage of embodiments, is that a tape edge machine that typically finishes the mattress cover enclosure on a core, may also be used with a dummy core remote from the final sales region. The mattress cover or covering may be finished, the dummy core removed, and the mattress cover can be collapsed, folded, and otherwise made compact for efficient and economical shipment to a region of use and sale. Utilizing a dummy core allows form fitting during manufacture, rather than sewing together a cover based on a pattern, facilitates easy inspection of the mattress covering at the factory with all exterior sides exposed when the dummy core is therein, and allows inspection of interior structure at the factory with the dummy core removed. At a region sale and use, mattress covers are easily and economically combined with inner springs cores or other cores to form the final mattress to be sold.

A feature and advantage of embodiments is that a dummy mattress core can be configured to facilitate the manufacturing of the mattress covers. Such dummy cores can be formed of material having a low coefficient of friction with respect to the materials they are contacting. Such dummy mattress core can be formed for example of polyethylene, or other polymers are much slippery with respect to the fabrics, fibers, paddings, cushioning materials conventionally used in mattresses allowing easier positioning of the fabrics, fibers, paddings, cushioning materials fabrics a. The dummy cores can be single piece or may utilize more than one portion assembled allowing, for example size adjustment of the dummy core. The cores may be slightly oversized in thickness, for example, to simulate a core and fiber pad to be installed at the final assembly facility. Such cores can be light weight and more dimensionally stable, for example more rigid, to be easier to handle than actual mattress cores.

Embodiments comprise manufacturing large quantities of mattress covers overseas using dummy cores, shipping the quantities of mattress covers to regional sales areas, for example in the U.S., receiving and stocking quantities of the mattress covers at assembly facilities, receiving and stocking quantities of mattress cores at assembly facilities, assembling the covers onto cores at the assembly facility, sending the assembled mattresses to distribution centers to be delivered to retail stores or direct to customers.

A feature and advantage of embodiments is manufacturing large quantities of mattress covers overseas, shipping the quantities of mattress covers to regional sales areas, for example in the U.S., distributing the mattress covers to retail stores, receiving and stocking at the retail stores the mattress covers, receiving and stocking at the retail stores mattress cores, assembling the covers onto cores at the retail store. In embodiments, the stocking of mattress covers will include different sizes, different plush levels, different fabrics, and different designs; and the stocking of the mattress cores will include different sizes, different firmness levels, different core designs, and different core types. In embodiments, the completed mattress assembly will be made after a selection of options and/or purchase by a customer of the retail store. In embodiments the retail store may be a brick and mortar physical store or may be an online retailer. Particularly compared to retail stores that currently manufacture their own mattresses, this essentially eliminates the need for stockpiling an array of raw materials at the retail store, eliminates the need for expensive and specialized mattress manufacturing equipment at the retail store, greatly reduces the manufacture time, and may offer greater selection and options to the customers.

A mattress in accordance with embodiments addresses the above issues and deficiencies and includes a mattress core and a collapsible mattress cover. A collapsible mattress cover includes a top panel component having front, back, left, and right peripheral edges. The top panel component further includes an upward facing layer opposite an interior material panel, with padding, fill, and or cushioning material therebetween. A singular sidewall border component having a top edge opposite a bottom edge, and a bottom portion having a bottom material panel with four peripheral edges. The top edge of the singular sidewall border component is fastened to the four peripheral edges of the top portion. A first peripheral edge of the bottom portion is fixedly attached to a first peripheral edge of the wall portion and the first peripheral edge of the bottom portion, and a zipper defines an opening in the bottom material panel configured to receive the mattress core. A mattress might conform to generally understood sizing standards. For example, according to embodiments, a mattress might be a twin, a double, an extra-long twin, a queen, a king, or a California king size. In embodiments, a collapsible mattress cover might be a custom size conforming to a particular mattress core.

In embodiments, the mattress core fits within the bottom portion of the collapsible mattress cover. In embodiments, the interior material panel is a foam panel. The foam panel may be glued to the upward facing layer. In embodiments, a foam layer is disposed between the upward facing layer and the interior material panel. The foam layer may be glued to the interior facing layer. In embodiments, the upward facing layer is a pillowtop. In embodiments, the top portion is fastened to the singular sidewall border component with a second zipper. In embodiments, the top portion is fastened to the singular sidewall border component with stitching. In embodiments, the top portion comprises a top wall portion affixed to the pillowtop with a tape seam. In embodiments, the zipper releasably attaches the remaining three peripheral edges of the bottom portion to the remaining three peripheral edges of the singular sidewall border component. In embodiments, the remaining three peripheral edges of the bottom portion are sewn to the remaining three peripheral edges of the singular sidewall border component and the zipper is offset from the peripheral edge.

According to embodiments, a collapsible mattress cover includes a top panel component with peripheral edges having an upward facing layer glued to an interior foam panel. The peripheral edges may be secured to a top edge of a singular sidewall border component with a tape seam. The top portion and singular sidewall border component define a cavity having a similar length, width, and height of a mattress core. A bottom portion includes a bottom material panel having four peripheral edges, wherein a first peripheral edge of the bottom material panel is fixedly attached to a first bottom peripheral edge of the singular sidewall border component. A zipper defines access to an opening in the bottom material panel configured to receive the mattress core. The zipper is positioned on the bottom side and extends around the periphery of the bottom side spaced from a lateral side and the head and foot sides defining a U-shape.

The remaining three peripheral edges of the bottom portion may be sewn to the remaining three peripheral edges of the singular sidewall border component. The zipper may be stitched to the bottom material such that it is offset from the remaining three peripheral edges and runs generally parallel to the three peripheral three edges. In embodiments, at least a portion of the top portion is affixed to the singular sidewall border component with a second zipper. According to embodiments, the upward facing layer of the collapsible mattress cover may be a pillowtop having added thickness of fabric, fibers, or other cushioning material. In embodiments, a buffer panel is disposed between a bottom surface of the mattress core and the bottom material panel.

According to an embodiment, a method of assembling a collapsible mattress cover includes providing a mattress core having four sides, a top, and a bottom; providing a singular sidewall border component fastened to a bottom material panel having four peripheral edges wherein the bottom material comprises a zipper corresponding to three of the peripheral edges; pulling the singular sidewall border component around each side of the mattress core; positioning the bottom material panel adjacent the bottom of the mattress core; laying a foam panel adjacent the top side of the mattress core; and applying glue to an outward facing surface of the foam panel. In embodiments, the method of assembling a collapsible mattress cover further includes placing a cushion material panel having four peripheral edges atop the glue; and fastening the four peripheral edges of the cushion material to the singular sidewall border component with a tape seam. In embodiments, the method of assembling a collapsible mattress cover further includes placing a top portion having four peripheral edges comprising an interior material panel adjacent the foam panel such that an inward facing surface of the interior material panel is secured to the glue; securing the top portion to the singular sidewall border component with a second zipper; applying glue to an outward facing surface of the interior material panel; placing a second foam panel adjacent the interior material panel; applying glue to an outward facing surface of the second foam panel; placing a second foam panel adjacent outward facing surface of the intermediate panel; applying glue to an outward facing surface of the second foam panel; placing a pillowtop panel adjacent the outward facing surface of the second foam panel; and affixing the pillowtop panel to the top portion with a tape seam.

A feature and advantage of embodiments is that a dummy mattress core can be configured to facilitate the manufacturing of the mattress covers. Such dummy cores can be formed of material having a low coefficient of friction with respect to the materials they are contacting. Such dummy mattress core can be formed for example of polyethylene. The cores may be slightly oversized in thickness, for example, to simulate a core and fiber pad to be installed at the final assembly facility. Such cores can be light weight and more dimensionally stable, for example more rigid, to be easier to handle than actual mattress cores.

A feature and advantage of embodiments is that a collapsible mattress cover may fabricated and shipped independently of a mattress core, thereby saving on costs while improving upon quality. A feature and advantage of embodiments is that assembling an independent collapsible mattress cover allows a manufacturer to choose from a wider variety of material components thereby offering broader choices and configurations to users. A feature and advantage of embodiments is that a collapsible mattress cover offers significant improvements in service and repair of a mattress such as servicing the core or cleaning and repairing fabric and other material components.

In embodiments, the cover is manufactured with a quilt top utilizing a dummy core, at least 1000 miles from a final mattress assembly location. The final mattress assembly location within 300 miles of a spring core assembly facility.

DESCRIPTION OF THE FIGURES

FIG. 3 is a prior art piece of textile or sheet material cutting equipment.

FIG. 4 is a perspective view of a generic prior art quilting machine for assembling top panel components of mattresses.

FIG. 5 is a perspective view of a generic prior art quilting machine for manufacturing quilted sidewall border components.

FIG. 6 is a perspective view of a generic prior art sewing machine.

DETAILED DESCRIPTION

Figure 1B:
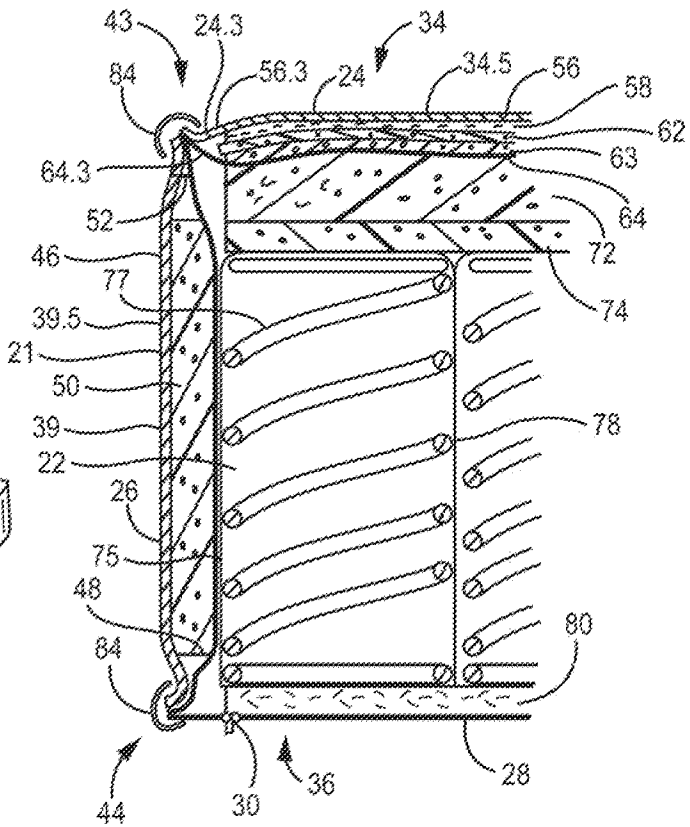
FIG. 1B is a cross sectional view of a portion of the mattress of FIG. 1.
Figure 2:
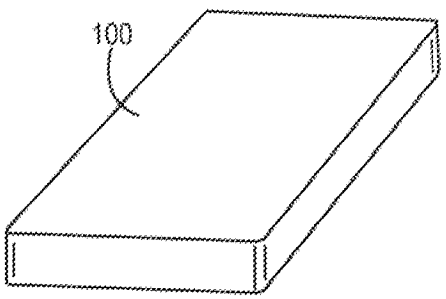
FIG. 2 is a perspective view of a dummy mattress core according to embodiments.
Figure 1A:
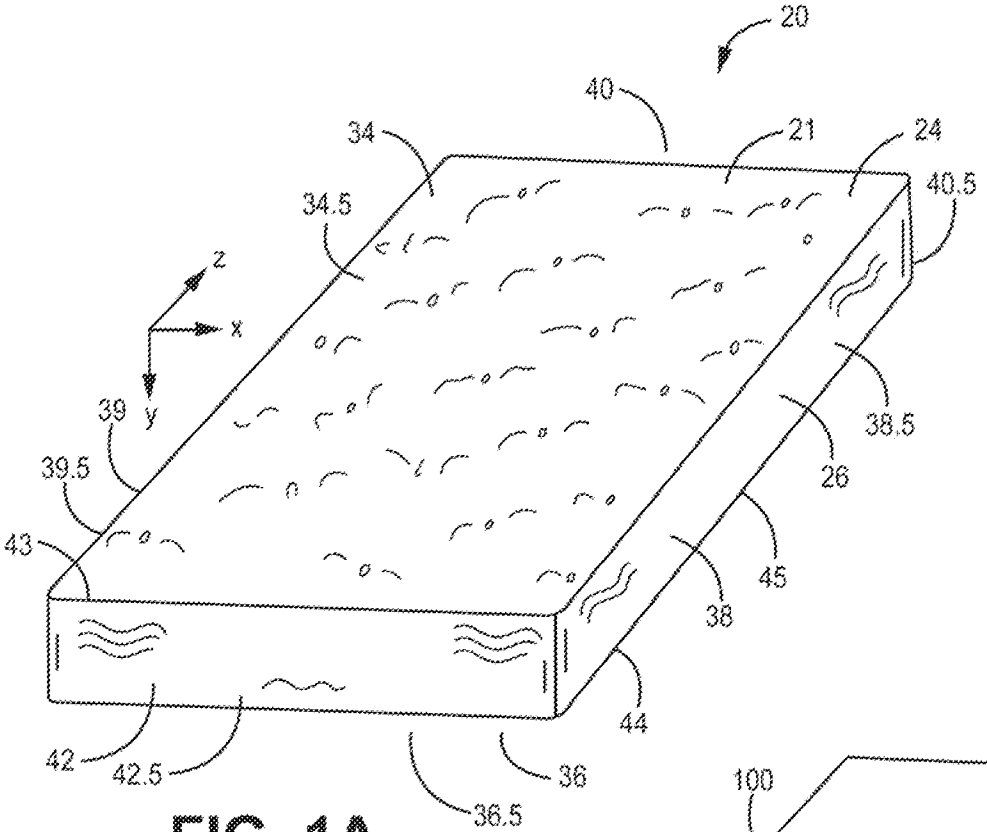
FIG. 1A is a top perspective view of a mattress according to embodiments.

Referring to FIGS. 1A and 1B, a mattress 20 in accord with embodiments has a mattress cover 21 and a mattress core 22. The mattress cover has a quilted top panel component 24, a quilted sidewall border component 26, and a bottom exterior thin fabric panel 28. The bottom exterior thin fabric panel has a zipper 30. Generally, the mattress has a top side 34, a bottom side 36, two lateral sides 38, 39, a head side 40, a foot side 42, an upper peripheral mattress corner 43, and a lower peripheral mattress corner 44 and generally a periphery 45. Accordingly, the mattress has an exposed top side surface 34.5, an exposed bottom side surface 36.5, exposed lateral side surfaces 38.5, 39.5, an exposed head side surface 40.5, and an exposed foot side surface 42.5. Typically, there is no differentiation between the head side and the foot side. The quilted sidewall border component 26 has an exterior fabric panel or strip 46, an interior thin fabric panel or strip 48, and a layer of foam 50 sandwiched between the exterior fabric and the interior thin fabric. The quilted sidewall border component may be held together by adhesives and/or stitching 52 extending through the quilting. Quilted sidewall border components 26 may be manufactured by specific equipment 53 dedicated to same, see prior art FIG. 5. Typically, a single sidewall border component panel or strip will extend around the entirety of the periphery 20.2 of the mattress providing a singular sidewall border component.

Referring still to FIGS. 1A and 1B, the quilted top panel component 24 generally has a top panel component edge portion 24.3, and comprises an exterior fabric panel 56 with an exterior panel edge portion 56.3, a layer of low density fiber 58, a first foam layer 62, a second foam layer 63, a thin interior fabric panel 64 with a fabric panel edge portion 64.3. Such quilted top panel components may be formed by conventional prior art equipment 67 such as is shown in prior art FIG. 4. The panels of fabric, fiber, foam or other cushioning material may be cut to size by conventional prior art equipment 69 as shown in prior art FIG. 3. The interior panels may be selectively sized to be slightly less area-wise than the exterior fabric panel 56 and the interior fabric panel 64 or may be the same size. Referring again to FIGS. 1A and 1B, below the quilted top panel component 24 is a first core foam layer 72, and a second core foam layer 74. Therebelow is a mattress core 75 illustrated as a pocket spring core having steel springs 77 contained in fabric pockets 78. A non-woven felt layer 80 may be positioned between the mattress core 75 and the bottom exterior thin fabric panel.

The upper peripheral mattress corner 43 and lower peripheral mattress corner 44 are formed by a conventional tape edge 84 that captures the quilted top panel component 24 at a top edge portion and the sidewall border component 26 forming the upper mattress corner 43 and captures the thin exterior fabric panel 29 and the quilted sidewall border component 26 at the lower corner 44. The tape edge 84 may be applied with a conventional tape edge equipment. For the lower corner with less layers to secure, a conventional sewing machine 88 as illustrated in prior art FIG. 6 may be utilized. For clarity of illustration, the tape edge 84 is shown spaced from the edge portions secured therein. In practice the tape edge and edge portions therein are tightly sewn together.

Figure 7:
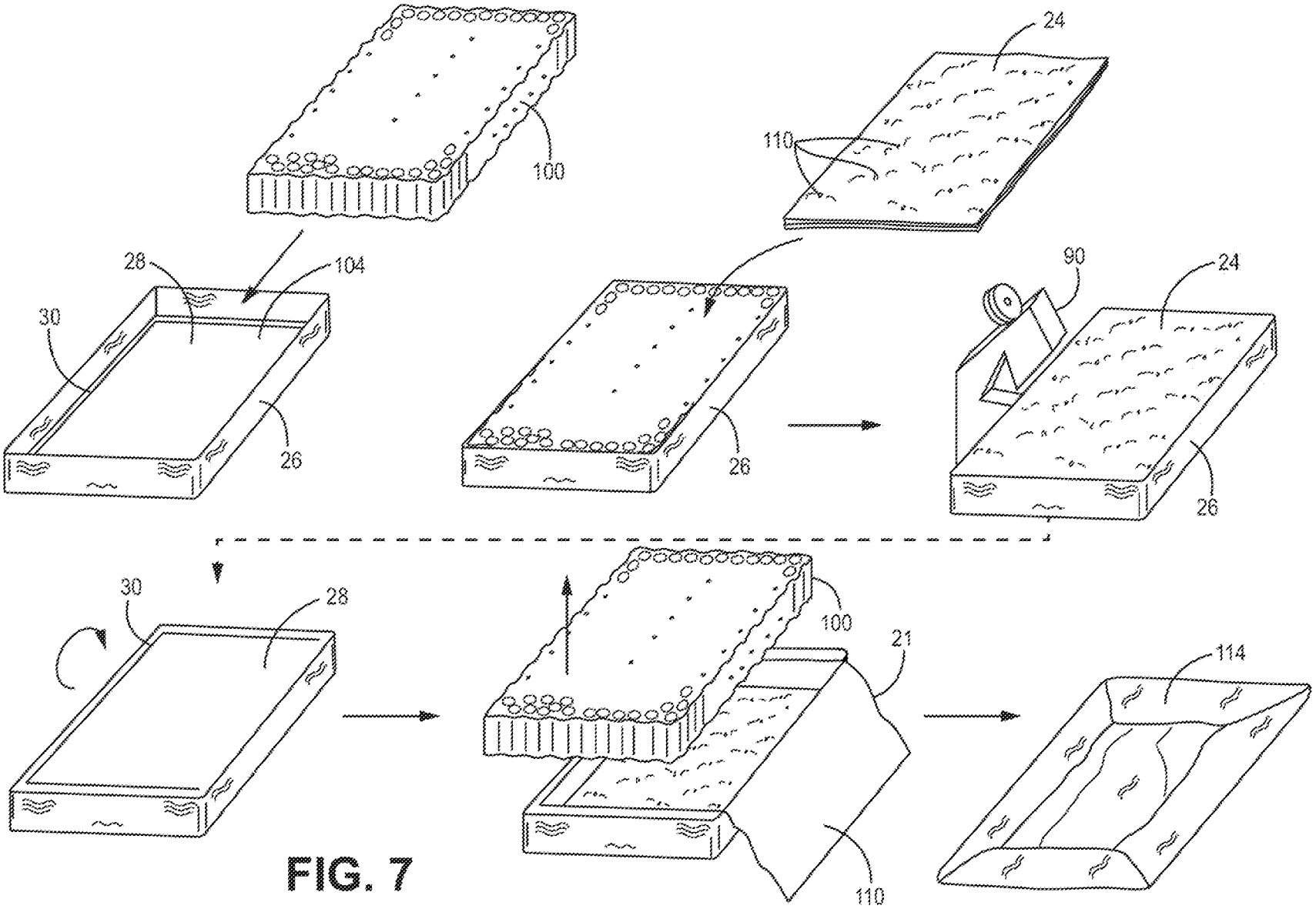
FIG. 7 is an illustrated sequence of manufacturing steps for a mattress cover according to embodiments.
Figure 8:
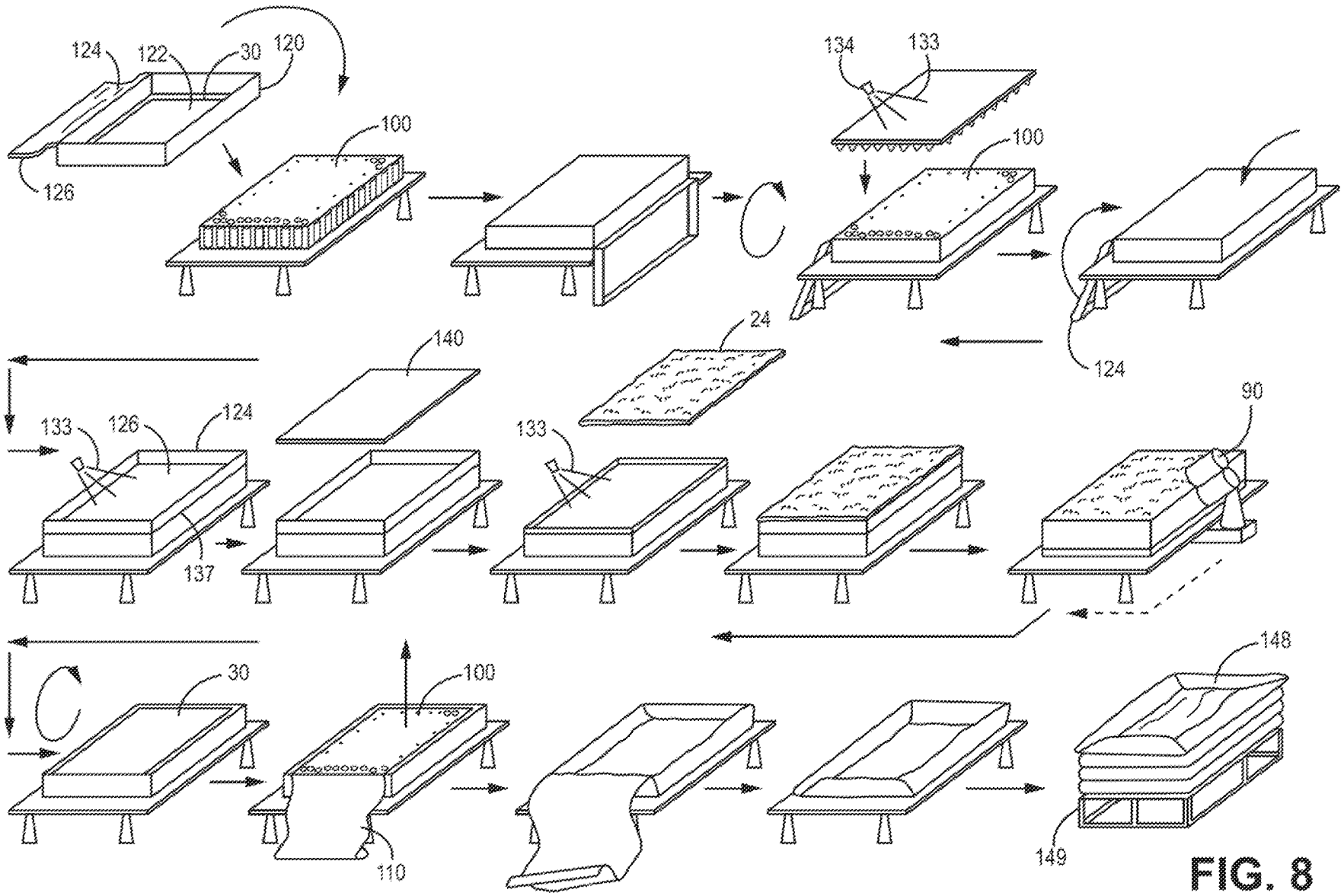
FIG. 8 is an illustrated sequence of manufacturing steps for a pillow top mattress cover according to embodiments.

The equipment of FIGS. 3-6 may be in a conventional mattress factory. An additional piece of conventional mattress manufacturing equipment is the tape edge machine 90 as shown in FIGS. 7 and 8. In embodiments, select equipment of Prior Art FIGS. 3-6 are located in a mattress cover factory that assemble the covers utilizing dummy cores and ships covers without a mattress core therein.

Referring to FIGS. 3 and 7, a sequence of manufacture of a mattress cover in such a mattress cover manufacturing facility is illustrated. First a half cap is assembled from quilted sidewall border component 26 sewn with tape edge to a lower exterior thin fabric panel 28 having a zipper installed therein. A dummy core 100, which is not intended to remain in the mattress cover, is installed in the pocket 104. The dummy core may be an actual spring core as shown in FIG. 7 or may be a correspondingly shaped 3 dimensional form, see FIG. 3, made of polymer or other suitable material. The dummy core may be an inflated form or filled with light weigh foam. In embodiments, the dummy core will weigh less than 10 lbs. (or 4.54 kilograms). In embodiments, the dummy core will weigh less than 6 lbs. (or 2.7 kilograms). In embodiments, the dummy core may be slightly dimensionally different that the actual core to be installed in the mattress cover. For example the dummy core may be smaller that the final core to be inserted into the mattress cover allowing a tighter fitting cover than a conventional mattress cover that is manufactured by sewing the mattress cover onto the actual core of the mattress. Note for illustration purposes the open mattress covers for receiving mattress cores appear self supporting; although quilted borders may have some capability of staying upright, generally the covers will need to be manually opened for insertion of mattresses. Also, the coverings may be applied over the core on a table to be fitted around the core and then have the core with cover thereon flipped over so that the open zippered opening may be zipped shut.

A quilted top panel component 24, which may have an ordered arrangement of fasteners 101 extending therethrough, is placed on the core and utilizing a tape edge machine 90 is attached to the quilted sidewall border component 26. The assembly is flipped over as indicated by the arrow 107, such that the bottom exterior thin fabric panel with the zipper is facing upwardly. The zipper 30 is opened, the flap 110 is pulled out of the way, and the dummy core 100 is removed. The mattress cover 21 may be zipped up and folded into a shipping configuration 114, with the sidewall border component 26 folded inwardly to be horizontal and in an overlaying and underlaying relationship with the top panel component 24 and the bottom panel 28. In embodiments, the mattress cover may remain unzipped.

Referring to FIG. 8, in embodiments, a pillow top mattress cover may be manufactured as illustrated. A half cap unit 120 with a first pocket 122 and a flap 124 with a second pocket 126 may be assembled by a conventional sewing machine. The bottom exterior thin fabric panel 28 with a zipper is joined to the quilted sidewall border component 26. The half cap unit 120 is flipped over and placed on a dummy core 100 with the first pocket containing the dummy core 100. The assembly is again flipped over such that the dummy core 100 is exposed facing upward. A layer of foam 130, such as an eggshell panel is place in the first pocket on the dummy core. Adhesive 133 may be sprayed on by a nozzle 134. The flap is closed and a flap zipper 137 is closed. Adhesive 133 may then be reapplied and a foam layer 140 is place in the second pocket 126 and is secured to the flap, again with adhesive. The flap may be formed of the same thin fabric as the bottom exterior thin fabric panel, for example woven polyester. A quilted top panel component 24 is secured to the foam layer 140 with adhesive. A edge tape machine secures the quilted top panel component 24 to the assembly. The assembly is flipped over, the zipper 30 opened, the flap 110 moved out of the way, and the dummy core 100 is removed. The assembled mattress cover 21 may be folded and stacked in a stack 148 on a pallet 149 for shipment to a mattress assembly facility. In embodiments, the mattress covers may be shrink wrapped or vacuum packed or simply shipped in plastic bags. In embodiments, the mattress coverings may be in compilations other than flat stacks on pallets. For example they may be folded up or rolled up and be put in boxes without vertical stacks.

Figure 9:
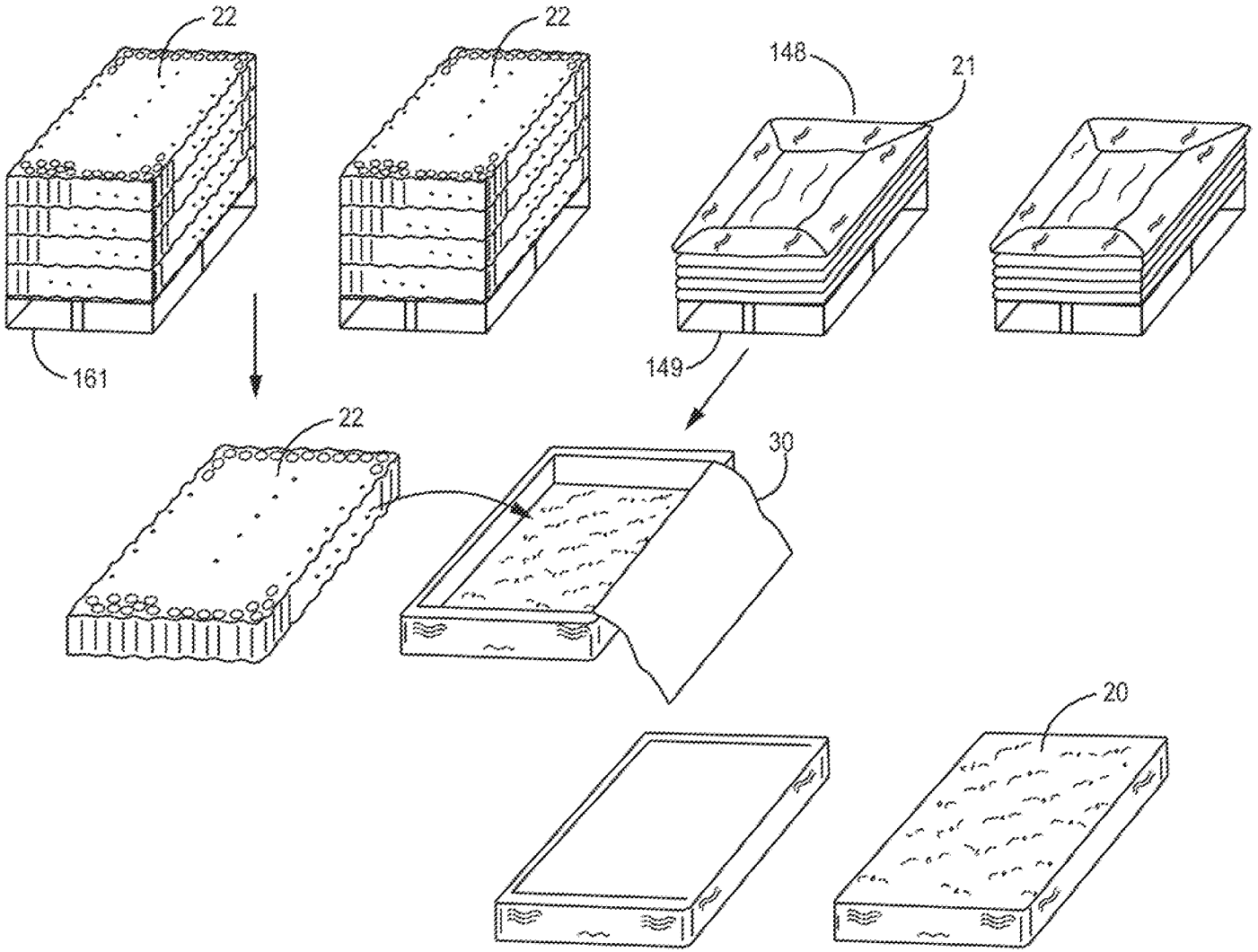
FIG. 9 is an illustrated sequence of assembly steps for a mattress from the mattress covers herein.

Referring to FIG. 9, the sequence of steps of assembling a mattress at a mattress assembly facility is illustrated. Pallets 149 with stacks 148 of mattress covers 21 provide inventory for the facility as well as pallets 161 of mattress cores 22. A suitable selection of a mattress cover and core are made and the mattress cover is simply opened by way of the zipper 30, the core is installed, and the zipper is closed. In instances, an addition layer of material such as foam or non-woven felt may be installed as well. The completed mattress 20 is ready for shipment or sale.

Figure 10:
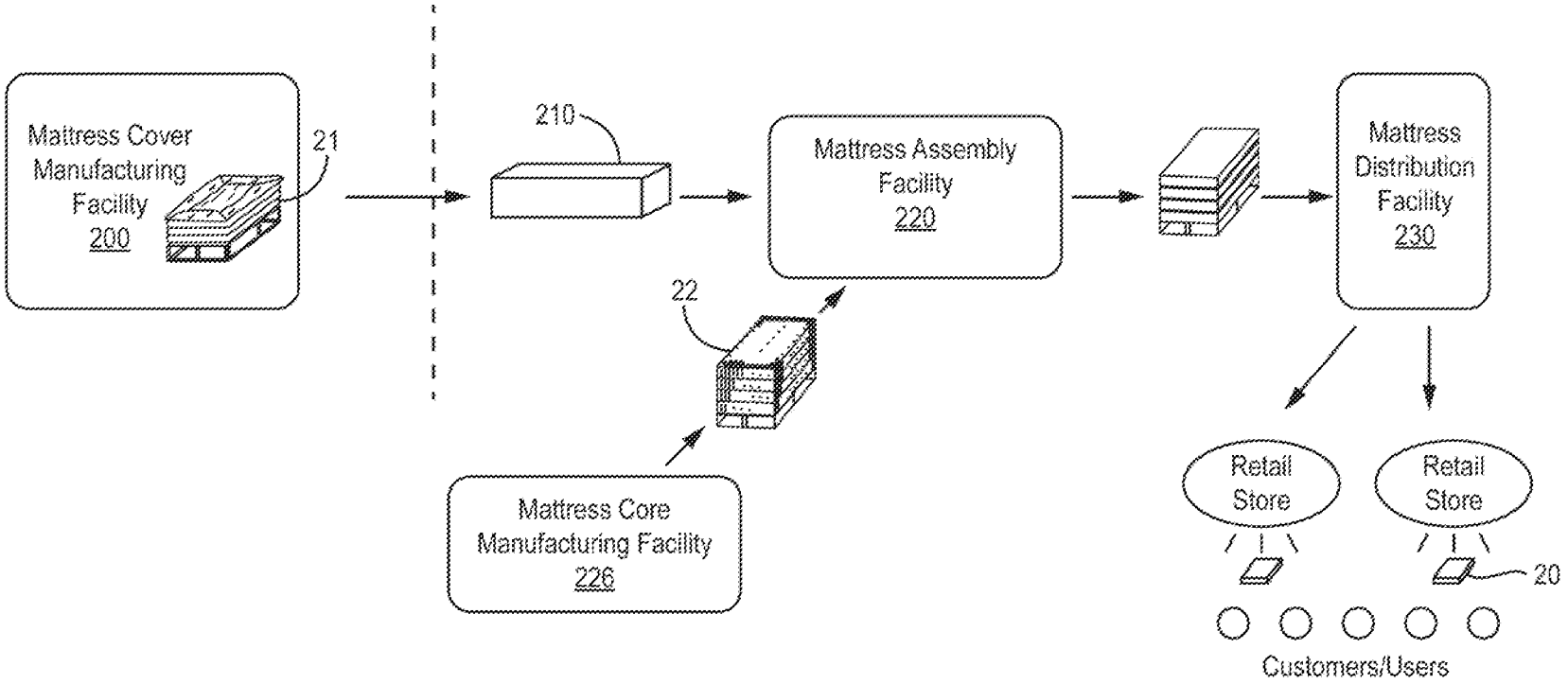
FIG. 10 is a diagrammatic illustration of utilizing the mattress covers in the chain of commerce of mattresses.

Referring to FIG. 10, methods of manufacturing, distributing, and selling mattresses are depicted. A mattress cover manufacturing facility 200 with operations such as described above ship out quantities of mattress covers. The facility may be in Asia in proximity to textile mills and labor. Containers 210 of the mattress covers may be shipped overseas to regional mattress assembly facilities 220. Such a facility will receive mattress cores from a different source, such as a mattress core manufacturing facility 226. The mattresses are assembled as described in the text associated with FIG. 9 and shipped to a distribution facility 230 where select mattresses are shipped to retail stores for direct sales to customers.

Figure 11:
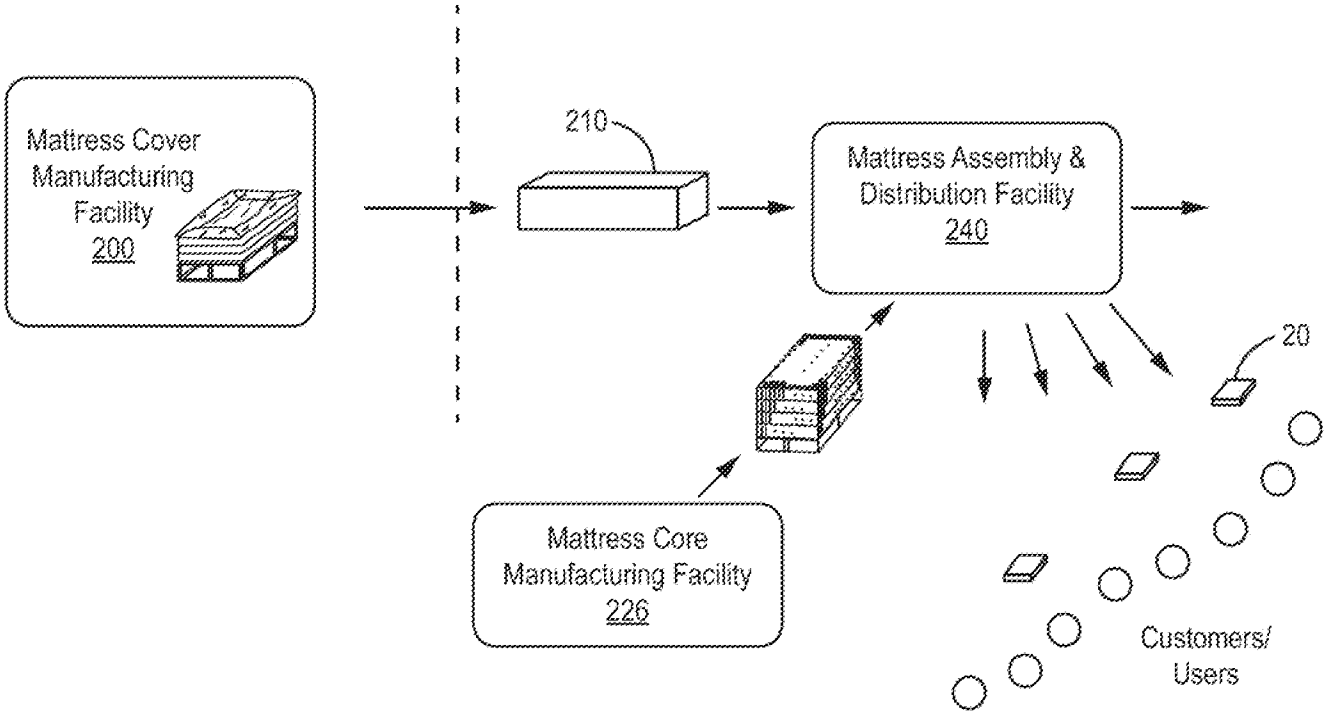
FIG. 11 is a diagrammatic illustration of utilizing the mattress covers in the chain of commerce of mattresses.

Referring to FIG. 11, another embodiment of methods of manufacturing, distributing, and selling mattresses are depicted. Here the mattress assembly facility is a distribution facility 240 and operates as a direct distributor of assembled mattresses 20 to retail customers.

Figure 12:
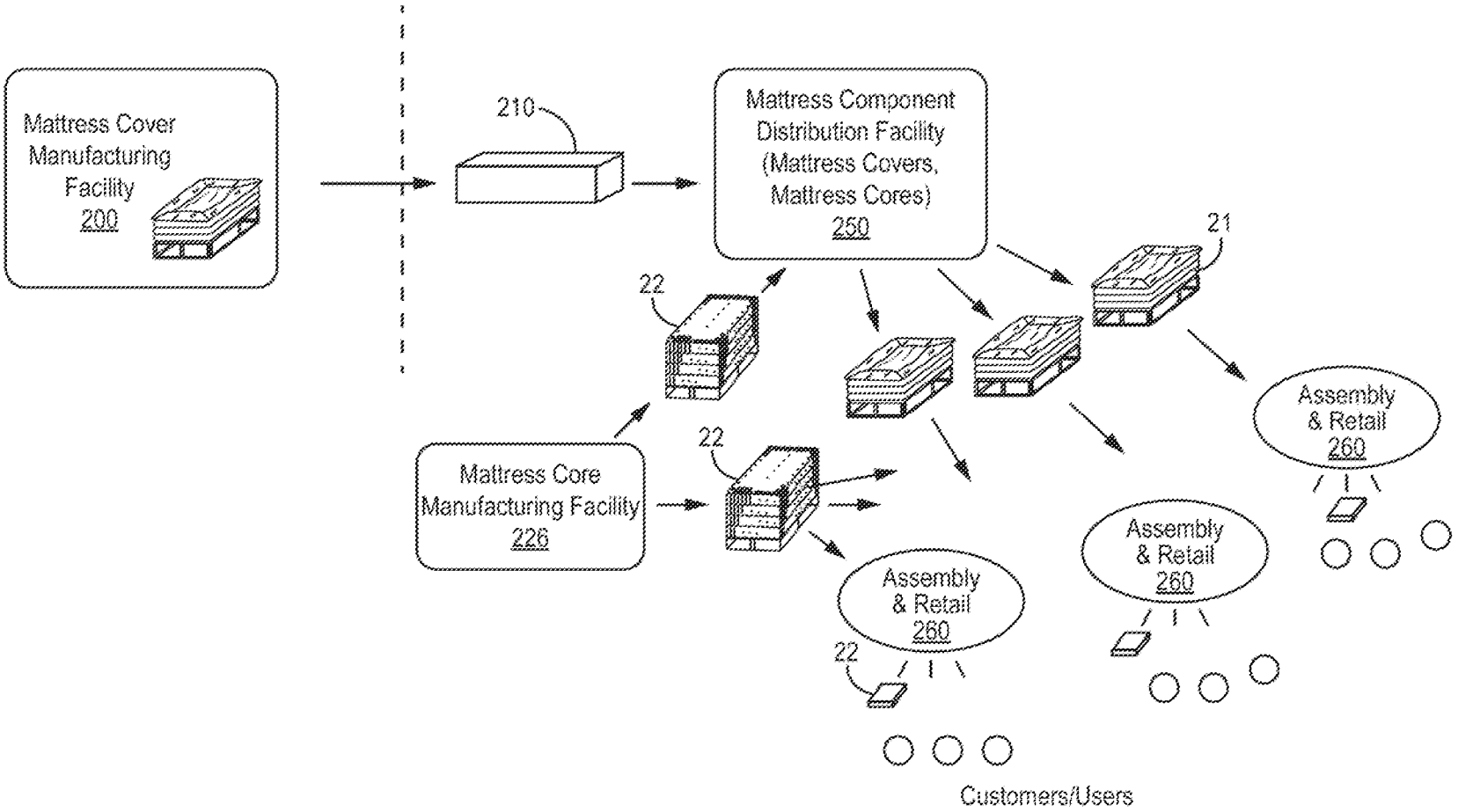
FIG. 12 is a diagrammatic illustration of utilizing the mattress covers in the chain of commerce of mattresses.

Referring to FIG. 12, another embodiment of methods of manufacturing, distributing, and selling mattresses are depicted. Here a distribution facility 250 distributes the mattress covers 21 to retail stores 260. Mattress cores may be provided to the retail stores from the distribution facility 250 or from other sources. The retail store then sells mattresses direct to customers and assembles the mattresses at the retail store. This may provide many selection options to the customer and does not have the equipment, labor, and material stocking issues of current retail mattress factories.

The following United States patents are hereby incorporated by reference herein for all purposes: U.S. Pat. Nos. 6,954,957; 7,089,618; 9,706,851; and 7,426,767. Published U.S. Patent Application US2013/0174350; US2007/0204566; US2008/0245690; US2014/0298589; US2015/0313373; US2016/0262549; and Us2002/0148047 are hereby incorporated by reference herein for all purposes. The above references to U.S. patents in all sections of this application are herein incorporated by references in their entirety for all purposes. Components illustrated in such patents may be utilized with embodiments herein. Incorporation by reference is discussed, for example, in MPEP section 2163.07 (B).

The above references in all sections of this application are herein incorporated by references in their entirety for all purposes. All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

I claim:

1. A stack or compilation of completed and empty quilted mattress coverings for subsequent assembly with respective mattress cores for providing completed mattresses for retail sale, each of the mattress coverings comprising:

a quilted top panel component having a periphery, the quilted top panel component comprising a top exterior fabric panel with a peripheral edge portion, a thin interior fabric panel with a peripheral edge portion, at least one foam layer with a peripheral edge and at least one low density fiber layer sandwiched between the exterior fabric panel and the thin interior fabric panel, the quilted top panel having an ordered arrangement of connections extending through the top panel thereby securing together the top exterior fabric panel, the thin interior fabric panel, the at least one foam layer, and the at least one low density fiber layer;

a quilted sidewall border component extending around the entire periphery, the quilted sidewall border component comprising an exterior fabric strip with an upper edge portion and a lower edge portion, a thin interior fabric strip with an upper edge portion and a lower edge portion, a foam or fiber layer strip sandwiched between the exterior fabric strip and the thin interior fabric strip, the quilted sidewall border component secured to the quilted top panel component by tape edge extending about and sewn to the top exterior fabric panel peripheral edge portion, the thin interior fabric panel peripheral edge portion, the upper edge portion of the exterior fabric strip, and the upper edge portion of the interior thin fabric strip; and a thin bottom fabric panel with an edge portion, the bottom fabric panel joined to the quilted sidewall border component by tape edge extending about and sewn to the thin bottom panel edge portion, the lower edge portion of the exterior fabric strip, and the lower edge portion of the thin interior fabric strip;

wherein the thin interior fabric panel of the quilted top panel component, the thin interior fabric strip of the quilted sidewall border component, and the thin bottom fabric panel of each quilted mattress covering define a mattress core receiving pocket sized to a common dummy core, and wherein the thin bottom fabric panel of each quilted mattress covering has a zipper extending along a plurality of four sides of a periphery of the thin bottom fabric panel for accessing the empty mattress core receiving pocket, and wherein each quilted mattress covering having five closed sides and one side openable and closeable with a zipper, wherein each of the quilted mattress coverings are sized by the dummy core, and wherein the dummy core is completely coverable by each of the quilted mattress coverings.

2. The stack or compilation of mattress coverings of claim 1, wherein the compilations or stacks are enclosed in a shipping container.

3. The stack or compilation of mattress coverings of claim 1, wherein each mattress covering is vacuum packed.

4. The stack or compilation of mattress coverings of claim 1, wherein each of the mattress coverings have a transportation configuration, a final assembly configuration, and a use configuration, such that in the transportation configuration the singular sidewall border component folds in upon itself defining a flattened and/or folded minimal volume state having a maximum thickness of less than 6 inches, in the filling configuration the zipper is an in open position and a portion of the material panel is pulled back, and in the use configuration the mattress core is located within the cavity and the zipper is in a sealed position.

5. A method of making a plurality of mattresses comprising:

for each of the quilted mattress coverings of claim 1, sewing the tape edge joining the quilted top panel to the quilted sidewall border utilizing the dummy core and a tape edge machine; and for each of the quilted mattress coverings of claim 1, sewing the tape edge joining the bottom fabric panel to the quilted sidewall border utilizing the dummy core and the tape edge machine.

6. The method of claim 5, further comprising: receiving the stack or compilation of quilted mattress coverings;

removing one of the mattress coverings from the stack of mattress;

unfolding the one mattress coverings;

unzipping the zipper of the one mattress covering if it is zipped;

inserting a pocketed spring core into the one mattress covering; and zipping the zipper of the one mattress covering.

7. The method of claim 6, further comprising:

repeating the steps of the method of claim 6 thereby producing a subsequent mattress; and placing the subsequent mattress atop a previously produced mattress.

8. The method of claim 7, further comprising bagging each of said mattresses.

9. The stack of compilation of quilted mattress coverings of claim 1, wherein the dummy core is a polymer dummy core.

* * * * *